US008156691B2

(12) United States Patent
Dickson et al.

(10) Patent No.: US 8,156,691 B2
(45) Date of Patent: Apr. 17, 2012

(54) MODULAR BUILDING STRUCTURE WITH FOLDABLE LANDING

(75) Inventors: Russell George Dickson, Martinsburg, PA (US); Gregory James Gorman, New Enterprise, PA (US)

(73) Assignee: New Enterprise Stone and Line Co., Inc, Roaring Spring, PA (US)

( * ) Notice: Subject to any disclaimer, the term of this patent is extended or adjusted under 35 U.S.C. 154(b) by 66 days.

(21) Appl. No.: 12/703,915

(22) Filed: Feb. 11, 2010

(65) Prior Publication Data

US 2011/0023382 A1 Feb. 3, 2011

Related U.S. Application Data

(60) Provisional application No. 61/230,882, filed on Aug. 3, 2009.

(51) Int. Cl.
*E04H 1/00* (2006.01)

(52) U.S. Cl. ..... 52/79.5; 52/68; 52/79.6; 16/387; 16/388

(58) Field of Classification Search ..... 52/79.1, 52/79.5, 79.6, 79.11, 73, 583.1, 68; 16/387–392, 16/267–269

See application file for complete search history.

(56) References Cited

U.S. PATENT DOCUMENTS

| | | | | |
|---|---|---|---|---|
| 2,691,291 | A * | 10/1954 | Henderson | 52/79.9 |
| 3,201,907 | A * | 8/1965 | Henderson | 52/73 |
| 3,724,141 | A * | 4/1973 | Kelleher | 52/79.11 |
| 4,726,155 | A * | 2/1988 | Nahmias | 52/71 |
| 4,865,213 | A * | 9/1989 | Kruger | 52/280 |
| 4,918,897 | A | 4/1990 | Luedtke | |
| 5,381,633 | A | 1/1995 | Hendrich | |
| 5,706,615 | A | 1/1998 | Bridges et al. | |
| 5,966,956 | A * | 10/1999 | Morris et al. | 62/259.1 |
| 6,070,372 | A | 6/2000 | Norman et al. | |
| 6,345,471 | B1 * | 2/2002 | Gyllenhammar | 52/69 |
| 6,968,653 | B2 | 11/2005 | Stapleton, Jr. et al. | |
| 6,983,567 | B2 * | 1/2006 | Ciotti | 52/79.5 |
| 6,997,495 | B1 * | 2/2006 | Groezinger | 296/26.15 |
| 7,216,741 | B2 * | 5/2007 | MacDonald et al. | 182/113 |
| 7,549,255 | B2 * | 6/2009 | Kirkwood | 52/69 |
| 2008/0282623 | A1 * | 11/2008 | Powell | 52/71 |

* cited by examiner

*Primary Examiner* — William Gilbert

*Assistant Examiner* — Gisele Ford

(74) *Attorney, Agent, or Firm* — Pepper Hamilton LLP

(57) ABSTRACT

Modular building structures and methods of forming such structures are disclosed. A modular building structure may include a plurality of walls, a ceiling and a landing. The plurality of walls may include a front wall. The ceiling may be positioned at a top portion of each of the plurality of walls and may have a top surface. The landing may be connected to the ceiling by one or more pin assemblies. The one or more pin assemblies are configured to enable the landing to be moved between a retracted position and an extended position. An upper surface of the landing may be adjacent to a top surface of the ceiling when the landing is in the retracted position. The landing may extend from the front wall when the landing is in the extended position.

20 Claims, 6 Drawing Sheets

MODULAR BUILDING STRUCTURE WITH FOLDABLE LANDING

CROSS REFERENCE TO RELATED APPLICATIONS

This application claims the priority benefit of U.S. Provisional Application No. 61/230,882 filed Aug. 3, 2009, the disclosure of which is totally incorporated herein by reference.

BACKGROUND

The present disclosure generally relates to modular building structures. More specifically, the present disclosure relates to modular building structures designed to be constructed off-site and transported using standard load transport.

Correctional facilities typically include a plurality of cells for inmates that are incarcerated on the premises. The cells constitute living quarters for the inmates during their incarceration. In many cases, cells are arranged in two levels where the top level of cells is placed directly over the lower level. The top level of cells commonly has a landing of approximately 4 feet in width and extending the length of the cells to enable inmates incarcerated on the upper level to enter and exit their cells.

Cells are constructed out of poured concrete. The concrete can be poured and allowed to form a single structure in order to enhance the strength of the structure. Cells are commonly grouped together in groups of, for example, two cells ("double module") or four cells ("quad module"). When fabricating double module cells, the landing and the cells are typically cast monolithically. However, the quad module cells and the landing are commonly fabricated separately and attached together at the correctional facility. However, using multiple concrete elements increases cost.

In some cases, the cells are produced off-site and are transported to the correction facility for installation. As commonly constructed, the cells are approximately 14 feet in width from front to back. Because the landing extends approximately an additional 4 feet from the front of the cell, the entire width of the cell block is approximately 18 feet.

Trucking companies must abide by various wide load and/or super load restrictions determined by each state. For example, when transporting a load over 16 feet in width in Pennsylvania, trucking companies are required to obtain a permit for a super load that requires a police escort. In most cases, a long lead time is required to obtain a super load permit. Moreover, most states only issue a limited number of super load permits per day for a single point of origin. Thus, super load transport is generally considered to be undesirable for at least the reasons listed above.

In contrast, a load between approximately 8.5 feet and 16 feet is merely classified as a wide load. In particular, a load between 13 feet and 16 feet is classified as a wide load that requires a car escort and for which permits are routinely issued. As such, the cost of transporting wide loads is significantly less than the cost of transporting super loads and the time to obtain permits for such loads is substantially less than for super loads.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. All publications mentioned in this document are incorporated by reference. All sizes recited in this document are by way of example only, and the invention is not limited to structures having the specific sizes or dimensions recited below. Nothing in this document is to be construed as an admission that the embodiments described in this document are not entitled to antedate such disclosure by virtue of prior invention. As used in this document, the term "comprising" means "including, but not limited to."

In an embodiment, a modular building structure may include a plurality of walls including a front wall, a ceiling positioned at a top portion of each of the walls, the ceiling having a top surface, and a landing connected to the ceiling by one or more pin assemblies. The one or more pin assemblies may be configured to enable the landing to be moved between a retracted position and an extended position. An upper surface of the landing may be adjacent to a top surface of the ceiling when the landing is in the retracted position, and the landing may extend from the front wall when the landing is in the extended position.

In an embodiment, a method of forming a modular building structure may include inserting a plurality of pin assemblies into a mold that defines inner and outer surfaces for each of a plurality of walls, a ceiling and a landing for a modular building structure. Each of the plurality of pin assemblies may be inserted at a location between a portion of the mold defining the ceiling and a portion of the mold defining the landing. The method may further include inserting a separator at a location proximate to each of the plurality of pin assemblies, pouring liquid concrete around the mold, allowing the liquid concrete to set, separating the modular building structure from the mold, and removing the separator from the modular building structure. The plurality of pin assemblies may be configured to enable the landing to be moved between a retracted position and an extended position.

In an embodiment, a modular building structure may include a plurality of walls including a front wall, a ceiling having a top surface positioned at a top portion of each of the walls, and a landing connected to the ceiling by one or more pin assemblies. The plurality of walls and the ceiling may form a contiguous structure having no seams. The one or more pin assemblies may be configured to enable the landing to be moved between a retracted position and an extended position. An upper surface of the landing may be adjacent to a top surface of the ceiling when the landing is in the retracted position, and the landing may extend from the front wall when the landing is in the extended position. Each pin assembly may include a pin, a cell-side portion connected to the ceiling, and a landing-side portion connected to the landing. The cell-side portion may include a receiving structure and a first supporting structure connected to a bottom side of the receiving structure. The landing-side portion may include a pin-receiving structure proximate to the receiving structure of the cell-side portion, a second supporting structure and a first headed concrete anchor.

DETAILED DESCRIPTION

Figure 1A:
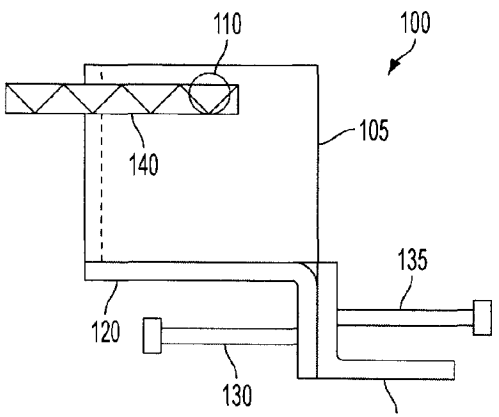
FIG. 1A depicts an elevation view of exemplary hardware and supporting material for a cell-side portion of a pin assembly according to an embodiment.
Figure 1B:
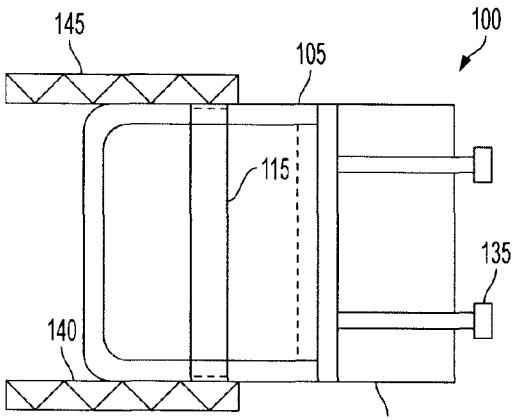
FIG. 1B depicts a plan view of exemplary hardware and supporting material for a cell-side portion of a pin assembly according to an embodiment.

FIGS. 1A and 1B depict elevation and plan views, respectively, of exemplary hardware and supporting material for a cell-side portion of a pin assembly according to an embodiment. As shown in FIGS. 1A and 1B, the cell-side portion of a pin assembly 100 comprises a receiving structure 105 having a hole 110 to receive a pin 115, a first supporting structure 120, attached to the bottom of the receiving structure, and a third supporting structure 125. Each of the first and third supporting structures 120, 125 include one or more headed concrete anchors ("HCAs"), such as 130 and 135, which are used to assist in anchoring the respective structure in concrete as described below. Rebar, such as 140 and 145, may be used to provide additional support to the cell-side portion of the pin assembly. In an embodiment, the first and third supporting structures 120, 125 may be tack welded together to enable the two structures to be separated at a later time as described further below in reference to FIGS. 5A-E.

In an embodiment, the receiving structure 105 may have outer dimensions of approximately 5"×6"×7" and be approximately ½" thick. In an embodiment, the hole 110 in the receiving structure 105 may be approximately 1" in diameter to accommodate the pin 115, which has substantially the same diameter. In an embodiment, a hole 110 may be present on each of two opposing sides of the receiving structure 105 such that the pin 115, when inserted, may extend through and out both sides of the receiving structure. In an embodiment, the first supporting structure 120 may be approximately 3.5"×6"×7" and may be approximately ⅜" thick. In an embodiment, the third supporting structure 125 may be approximately 3"×3"×9" and may be approximately ⅜" thick. As shown in FIGS. 1A and 1B, two ½"×4" HCAs, such as 130 and 135, may be attached to each of the supporting structures 120, 125 to anchor the structures in concrete, when poured. In an embodiment, each of the receiving structure 105, pin 115, first and third supporting structures 120, 125, and HCAs 130, 135 may be made of steel. Alternate materials and sizes for each of the components of the cell-side portion of the pin assembly 100 may also be used within the scope of this invention.

Figure 2A:
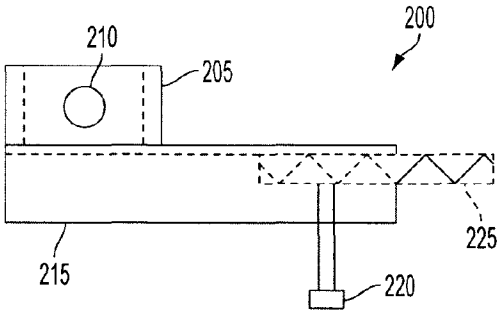
FIG. 2A depicts an elevation view of exemplary hardware and supporting material for a landing side portion of a pin assembly according to an embodiment.
Figure 2B:
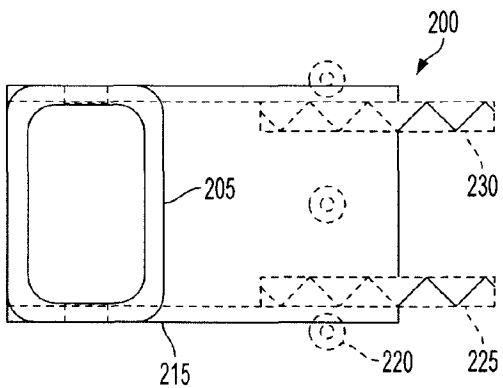
FIG. 2B depicts a plan view of exemplary hardware and supporting material for a landing side portion of a pin assembly according to an embodiment.

FIGS. 2A and 2B depict elevation and plan views, respectively, of exemplary hardware and supporting material for a landing-side portion of a pin assembly according to an embodiment. As shown in FIGS. 2A and 2B, the landing-side portion of the pin assembly 200 comprises a pin-receiving structure 205 having a hole 210 to receive a pin, such as 115, a second supporting structure 215, attached to the bottom of the pin-receiving structure, and one or more HCAs, such as 220. The pin-receiving structure 205 may be designed to be received within the receiving structure 105 of the cell-side portion of the pin assembly 100 and to enable rotation of the pin-receiving structure (and thus the landing) around the pin 115. The one or more HCAs, such as 220, are used to assist in anchoring the respective structure in concrete as described below. Rebar, such as 225 and 230, may be used to provide additional support to the cell-side portion of the pin assembly.

In an embodiment, the pin-receiving structure 205 may have outer dimensions of approximately 2"×4"×6" and be approximately ½" thick. In an embodiment, the hole 210 in the pin-receiving structure 205 may be approximately 1" in diameter to accommodate the pin 115. The hole 210 may be configured to align with the hole 110 of the cell-side portion of the pin assembly 100. In an embodiment, a hole 210 may be present on each of two opposing sides of the pin-receiving structure 205 such that the pin 115, when inserted, may extend through and out both sides of the pin-receiving structure. In an embodiment, the second supporting structure 215 may be approximately 2"×10"×6". As shown in FIGS. 2A and 2B, three ½"×4" HCAs, such as 220, may be attached to the supporting structure 215 to anchor the second supporting structure in concrete, when poured. In an embodiment, each of the pin-receiving structure 205, second supporting structure 215, and one or more HCAs 220 may be made of steel. Alternate materials and sizes for each of the components of the landing-side portion of the pin assembly 200 may also be used within the scope of this invention.

Figure 3:
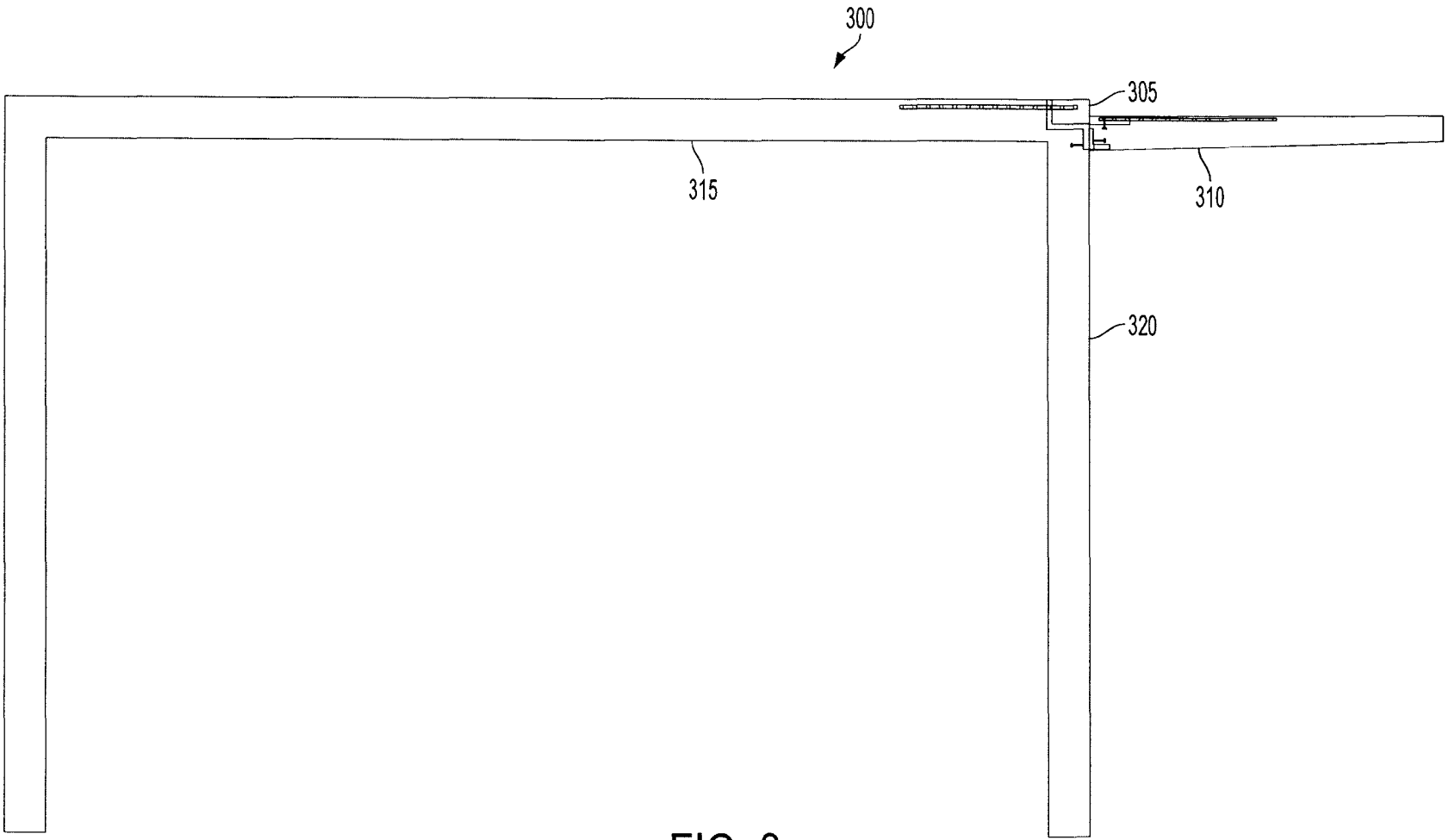
FIG. 3 depicts a cross-sectional view of an exemplary modular building structure including a landing in an extended position according to an embodiment.

FIG. 3 depicts a cross-sectional view of an exemplary modular building structure including a landing in an extended position according to an embodiment. As shown in FIG. 3, the pin assembly 305 may be encased within poured concrete that forms a modular building structure 300. The modular building structure 300 may be formed by pouring concrete in a mold (form) that may include a plurality of walls and one or more inner cores. After the concrete sets, the walls and cores are withdrawn and the building structure is removed from the mold.

In an embodiment, the outer dimensions of the main portion of the modular building structure 300 may be approximately 103.5" high and approximately 168" long. In an embodiment, the top side 315 of the main portion of the modular building structure 300 may be approximately 5" thick, and each wall, such as 320, of the main portion of the modular building structure may be approximately 6" thick. In an embodiment, the thickness of the top side 315 and walls 320 of the main portion of the modular building structure may correspond to the dimensions of the cell-side portion of the pin assembly 100.

Figure 4:
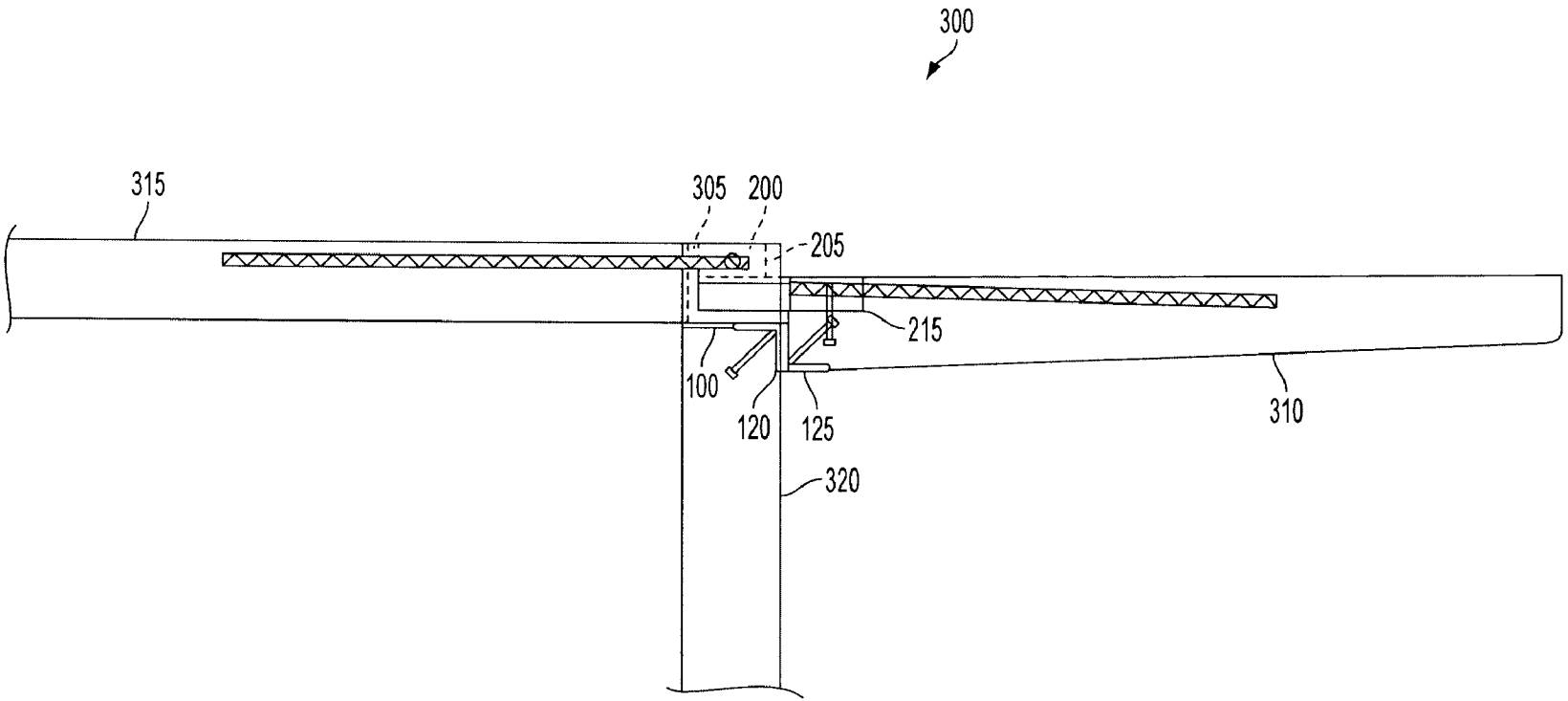
FIG. 4 depicts a close up cross-sectional view of the landing in an extended position and an adjoining portion of the modular building structure according to an embodiment.

The modular building structure 300 may additionally include a landing 310 that is approximately 48" in length. As further shown in FIG. 4, the cell-side portion of the pin assembly 100 may be placed such that the cell-side portion occupies a corner of the main portion of the modular building structure. In particular, the contact plane between the first and third supporting structures 120, 125 of the cell-side portion of the pin assembly may be coincident with the outer side of a wall of the modular building structure 300. As such, the landing 310 may be flush against the wall of the modular building structure when in an extended position. In addition, the top of the landing 310 may be substantially in the same plane as the top of the second supporting structure 215 of the landing-side portion of the pin assembly 200. It is noted that the landing 310 is offset by the height of the pin-receiving structure 205 of the landing-side portion of the pin assembly 200. This offset and the dimensions of the pin assembly 305 enables the landing 310 to be rotated such that the landing will not substantially contact the top side 315 of the main portion of the modular building structure 300 unless the entirety of the landing is positioned on the top side. The offset may be filled with concrete to be made substantially even with the top side 315 of the main portion of the modular building structure 300 at a final installation location after the landing 310 has been placed in an extended position.

Figure 5C:
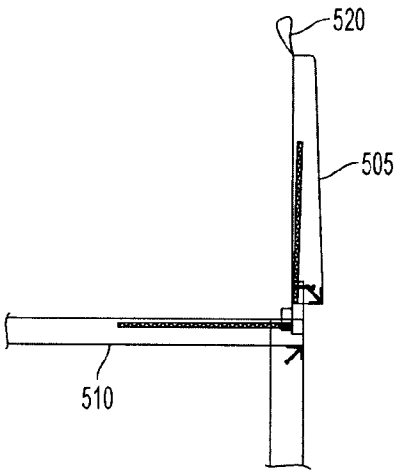
FIGS. 5A-E depict an exemplary landing according to an embodiment in a plurality of positions as it is moved from a retracted position and an extended position.
Figure 5B:
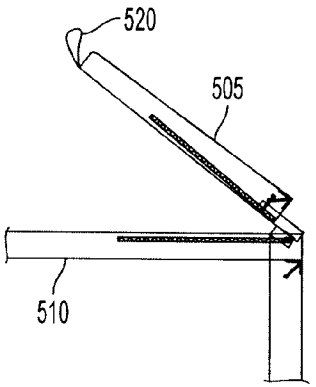
Figure 5A:
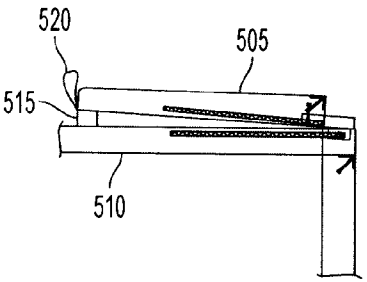
Figure 5D:
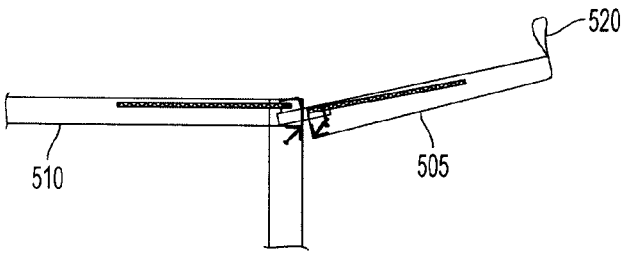

FIGS. 5A-E depict an exemplary landing according to an embodiment in a plurality of positions as it is moved from a retracted position and an extended position. As shown in FIG. 5A, the landing 505 may initially be placed in a retracted position. One reason for placing the landing 505 in a retracted position may be to permit transport of the modular building structure in more compact dimensions while retaining the physical integrity of the structure. As a result, assembly costs may be reduced when the modular building structure reaches its destination. In the retracted position, the landing 505 may be separated from the top side 510 of the modular building structure 500 by dunnage 515. The dunnage 515 may be used to prevent structural damage to either the landing 505 or the top side 510 of the modular building structure 500 during transport.

Figure 5E:
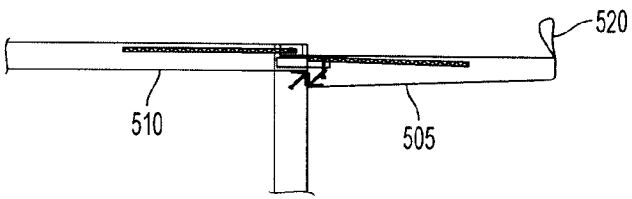

A lifting loop 520 may be attached to the landing 505 when the landing is setting. The lifting loop 520 may be used to assist in moving the landing 505 from a retracted position to an extended position (as is shown in FIG. 5E), or vice versa. The lifting loop 520 may be removed from the landing 505 when the modular building structure is installed and the landing is placed in its extended position. FIGS. 5A-5E depict the landing 505 in various positions from the retracted to the extended positions.

Figure 6:
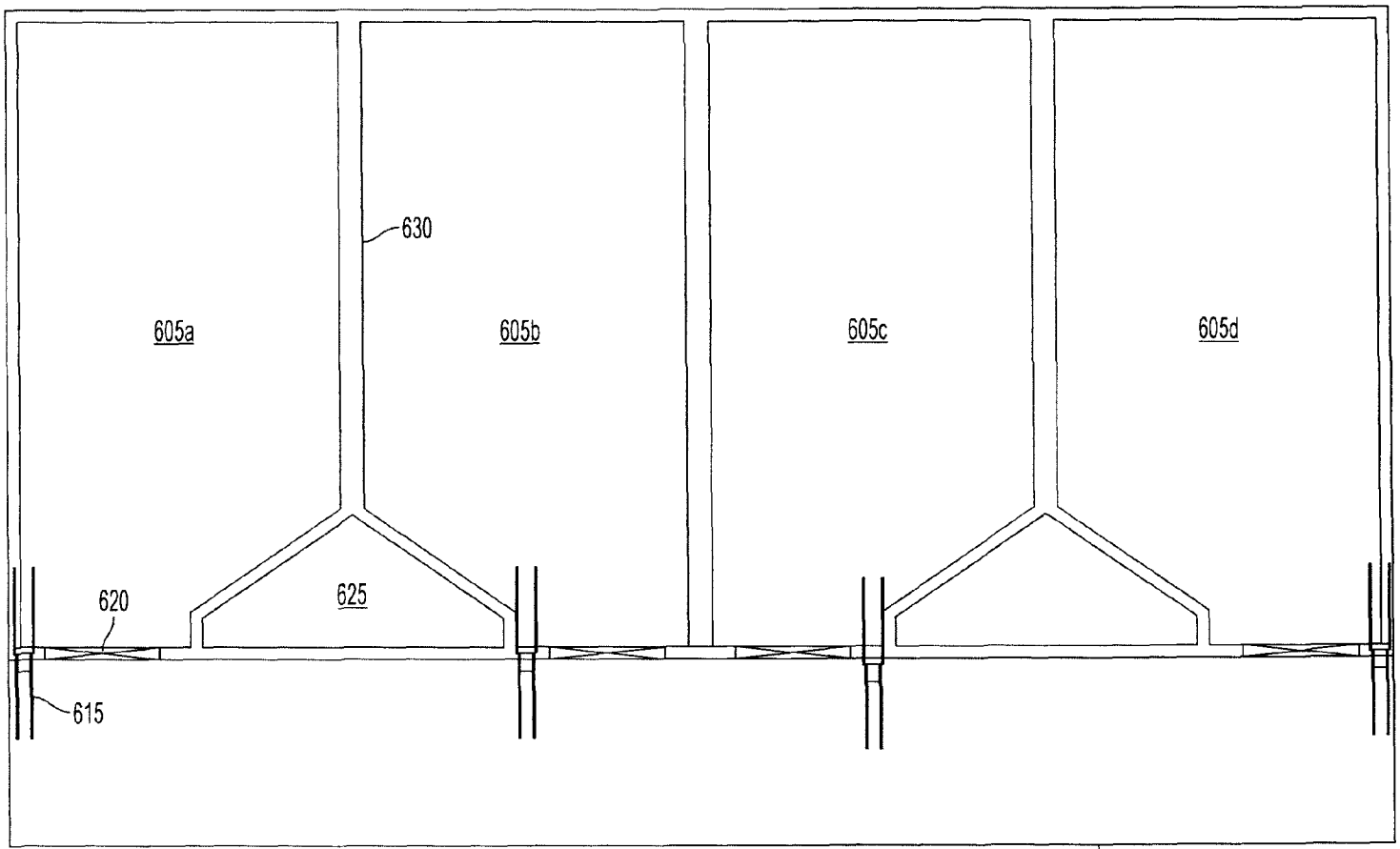
FIG. 6 depicts a top cross-sectional view of a plurality of exemplary cells, a plurality of exemplary pin assemblies and an exemplary landing for a modular building structure according to an embodiment.

FIG. 6 depicts a top cross-sectional view of a plurality of exemplary cells, a plurality of exemplary pin assemblies and an exemplary landing for a modular building structure according to an embodiment. As shown in FIG. 6, four cells 605*a-d* may be included in a modular building structure 600. In an embodiment, the modular building structure 600 may be approximately 30 feet wide and 14 feet deep (not including the landing 610). The pin assemblies, such as 615, may enable the landing to be positioned in a retracted position, an extended position, or a plurality of positions in between. In an embodiment, the modular building structure 600 may be formed as a unit by pouring concrete and allowing it to set for all cells 605*a-d* substantially simultaneously. The modular building structure 600 may include one or more interior walls, such as 630, configured to separate adjacent cells, such as 605*a* and 605*b*. In an embodiment, the modular building structure 600, other than the landing, may be contiguously formed having no seams between the walls and the ceiling.

The modular building structure 600 may be configured to be transported as a unit by placing the landing 610 in the retracted position. In such a position, the modular building structure 600 may be within size restrictions for wide load transport for a plurality of jurisdictions. The landing 610 of the modular building structure 600 may be moved to the extended position for use as a walkway when, for example, the modular building structure is installed at an installation site.

Each cell, such as 605*a*, may have a door opening, such as 620, for entering the cell and may further be proximate to an enclosed space, such as 625, for providing utilities and plumbing to the cell. Connections between the utilities and plumbed devices in a cell 605*a* and the utilities and plumbing in an adjacent enclosed space 625 may be made, for example, at the installation site.

In an embodiment, a plurality of modular building structures 600 may be placed side-by-side to form a block of cells. In an embodiment, a plurality of modular building structures 600 may be stacked one atop another to provide multiple levels of cells. In such an embodiment, the floor of the cells in an upper modular building structure may be the ceiling of a lower modular building structure. In an embodiment, an upper modular building structure may not include a landing.

Figure 7:
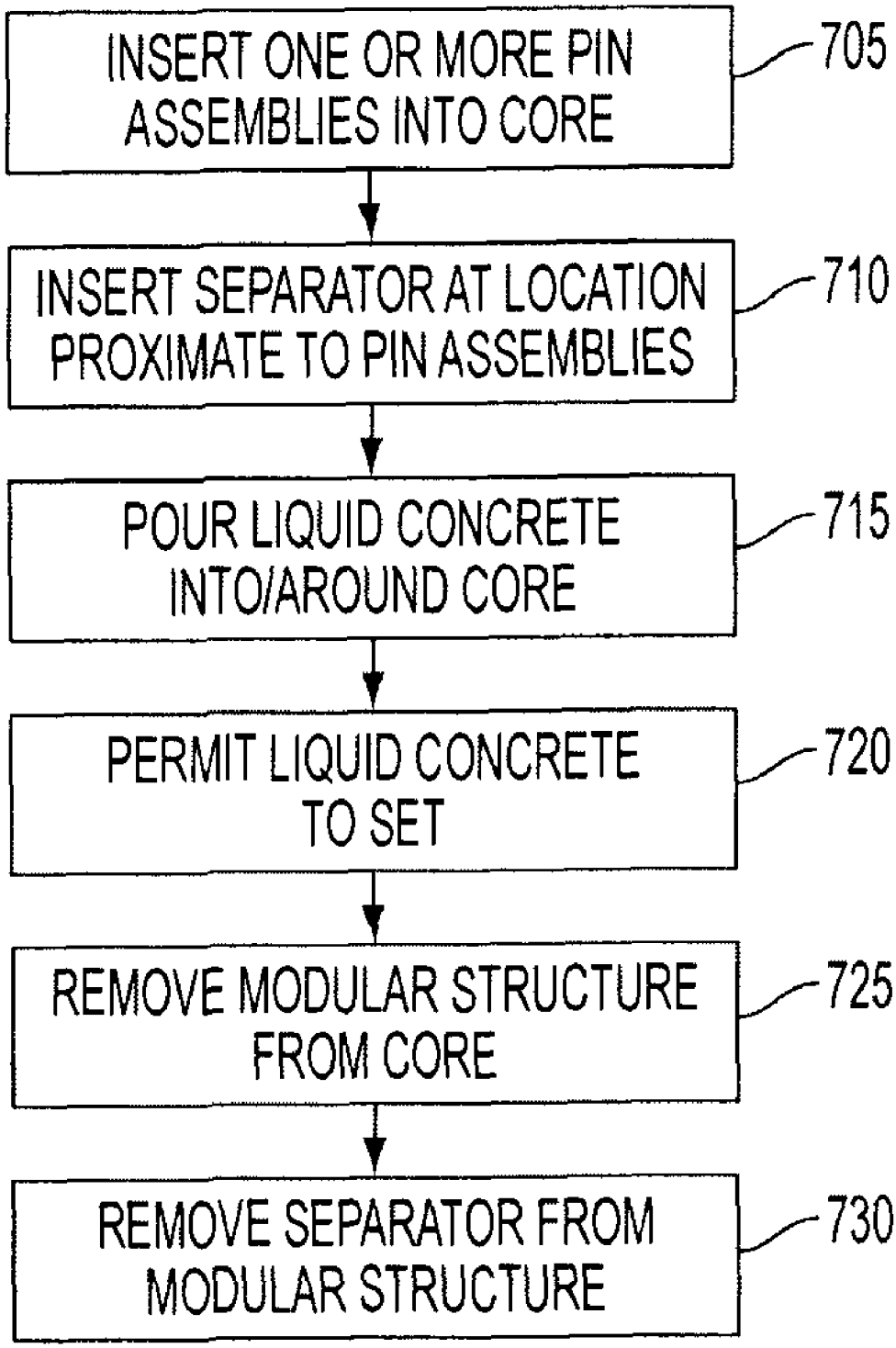
FIG. 7 depicts a flow diagram of an exemplary method of forming a modular building structure having a landing according to an embodiment.

FIG. 7 depicts a flow diagram of an exemplary method of forming a modular building structure having a landing according to an embodiment. As shown in FIG. 7, a plurality of pin assemblies may be inserted 705 into a mold. The mold may be a structure that defines inner and outer surfaces for each of a plurality of walls, a ceiling and a landing for a modular building structure. The plurality of pin assemblies may be inserted 705 at locations between a portion of the mold defining the ceiling and a portion of the mold defining the landing.

A separator may be inserted 710 at a location proximate to the plurality of pin assemblies. The separator may be used to prevent concrete from solidifying between the front wall of a modular building structure and the landing. The separator may extend from one side of the mold to the other, and may be interrupted at each pin assembly. In an embodiment, the separator may be made of fiberglass or any other material that can be removed from the concrete after it sets.

Liquid concrete may be poured 715 into and/or around the mold. The liquid concrete may be prevented from entering the pin assemblies because the pin assemblies may be encased in a protective structure.

The liquid concrete may then be permitted to set 720. Once the concrete has set, the modular building structure may be removed 725 from the mold. In an embodiment, the mold may include hydraulic or mechanical mechanisms to assist in removing the modular building structure from the mold. When the concrete has set 720, the modular building structure may be removed 725 by, for example, compressing one or more portions of the mold using the hydraulic or mechanical mechanisms. Because the modular building structure is now formed of solid concrete, collapsing the walls and removing 725 the one or more cores may not cause the concrete to lose its shape.

The separator may also be removed 730 from the modular building structure. In an embodiment, the separator may be removed 730 during or after causing the landing to be moved from an extended position to a retracted position.

As taught above in reference to FIGS. 1-6, the plurality of pin assemblies may enable the landing to be moved between retracted and extended positions. In an embodiment, one or more lifting loops may be used to assist in movement between these positions. The one or more lifting loops may be placed in the concrete prior to it setting.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A modular building structure comprising:

a plurality of walls including a front wall;

a ceiling positioned at a top portion of each of the walls, the ceiling having a top surface; and a landing connected to the ceiling by one or more pin assemblies, wherein the one or more pin assemblies are configured to enable the landing to be moved between a retracted position and an extended position, wherein an upper surface of the landing is adjacent to a top surface of the ceiling when the landing is in the retracted position, wherein the landing extends from the front wall when the landing is in the extended position, wherein a pin assembly of the one or more pin assemblies comprises:

a pin, a cell-side portion connected to the ceiling, the cell-side portion comprising a receiving structure and a first supporting structure connected to a bottom side of the receiving structure, and a landing-side portion connected to the landing, the landing-side portion comprising a pin-receiving structure proximate to the receiving structure of the cell-side portion, a second supporting structure and a first headed concrete anchor.

2. The modular building structure of claim 1, wherein the receiving structure comprises a hole to receive the pin.

3. The modular building structure of claim 2, wherein the pin-receiving structure comprises a hole to receive the pin.

4. The modular building structure of claim 1, wherein the first supporting structure comprises a second headed concrete anchor.

5. The modular building structure of claim 1, further comprising a third supporting structure configured to support the landing and removably connected to the first supporting structure.

6. The modular building structure of claim 1, wherein each of the plurality of walls, the ceiling and the landing comprise concrete.

7. The modular building structure of claim 1, wherein the plurality of walls and the ceiling form a contiguous structure having no seams.

8. The modular building structure of claim 1, wherein the plurality of walls further include one or more interior walls configured to separate adjacent cells.

9. A modular building structure comprising:

a plurality of walls including a front wall;

a ceiling positioned at a top portion of each of the walls, the ceiling having a top surface; and a landing connected to the ceiling by one or more pin assemblies, wherein the plurality of walls and the ceiling form a contiguous structure having no seams, wherein the one or more pin assemblies are configured to enable the landing to be moved between a retracted position and an extended position, wherein an upper surface of the landing is adjacent to a top surface of the ceiling when the landing is in the retracted position, wherein the landing extends from the front wall when the landing is in the extended position, wherein each pin assembly comprises a pin, a cell-side portion connected to the ceiling and comprising a receiving structure and a first supporting structure connected to a bottom side of the receiving structure, and a landing-side portion connected to the landing and comprising a pin-receiving structure proximate to the receiving structure of the cell-side portion, a second supporting structure and a first headed concrete anchor.

10. The modular building structure of claim 9, wherein the receiving structure comprises a hole to receive the pin.

11. The modular building structure of claim 10, wherein the pin-receiving structure comprises a hole to receive the pin.

12. The modular building structure of claim 9, wherein the first supporting structure comprises a second headed concrete anchor.

13. The modular building structure of claim 9, further comprising a third supporting structure configured to support the landing and removably connected to the first supporting structure.

14. The modular building structure of claim 9, wherein each of the plurality of walls, the ceiling and the landing comprise concrete.

15. The modular building structure of claim 9, wherein the plurality of walls further include one or more interior walls configured to separate adjacent cells.

16. A modular building structure comprising:

a plurality of walls including a front wall;

a ceiling positioned at a top portion of each of the walls, the ceiling having a top surface; and a landing connected to the ceiling by one or more pin assemblies, wherein each pin assembly comprises:

a pin, a cell-side portion connected to the ceiling, wherein the cell-side portion comprises a receiving structure having a hole in a first side wall and a hole in an opposing side wall, a first supporting structure connected to a bottom side of the receiving structure, and a second supporting structure removably attached to the first supporting structure, and a landing-side portion connected to the landing, wherein the landing-side portion comprises a pin-receiving structure having a hole in a first side wall and a hole in an opposing side wall, and a third supporting structure connected to a bottom side of the pin-receiving structure.

17. The modular building structure of claim 16, wherein the receiving structure comprises a hole to receive the pin, and wherein the pin-receiving structure comprises a hole to receive the pin.

18. The modular building structure of claim 16, further comprising a third supporting structure configured to support the landing and removably connected to the first supporting structure.

19. The modular building structure of claim 16, wherein each of the plurality of walls, the ceiling and the landing comprise concrete.

20. The modular building structure of claim 16, wherein the plurality of walls further include one or more interior walls configured to separate adjacent cells.

* * * * *

UNITED STATES PATENT AND TRADEMARK OFFICE

CERTIFICATE OF CORRECTION

PATENT NO. : 8,156,691 B2
APPLICATION NO. : 12/703915
DATED : April 17, 2012
INVENTOR(S) : Dickson et al.

It is certified that error appears in the above-identified patent and that said Letters Patent is hereby corrected as shown below:

Title Page, Item (73) Assignee should read

-- New Enterprise Stone and Lime Co., Inc., Roaring Spring, PA (US) --

Signed and Sealed this
Third Day of July, 2012

David J. Kappos

David J. Kappos
*Director of the United States Patent and Trademark Office*